US010689725B2

(12) United States Patent
Lenze et al.

(10) Patent No.: US 10,689,725 B2
(45) Date of Patent: Jun. 23, 2020

(54) METHOD FOR PRODUCING A COMPONENT HAVING IMPROVED ELONGATION AT BREAK PROPERTIES

(71) Applicants: Franz-Josef Lenze, Lennestadt (DE); Sascha Sikora, Lünen (DE); Janko Banik, Altena (DE)

(72) Inventors: Franz-Josef Lenze, Lennestadt (DE); Sascha Sikora, Lünen (DE); Janko Banik, Altena (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 205 days.

(21) Appl. No.: 15/461,783

(22) Filed: Mar. 17, 2017

(65) Prior Publication Data

US 2017/0191142 A1 Jul. 6, 2017

Related U.S. Application Data

(63) Continuation of application No. 13/156,260, filed on Jun. 8, 2011, now abandoned, which is a continuation (Continued)

(30) Foreign Application Priority Data

Dec. 12, 2008 (DE) ..... 10 2008 055 514

(51) Int. Cl.
*C21D 9/52* (2006.01)
*C21D 1/25* (2006.01)

(Continued)

(52) U.S. Cl.
CPC ..... *C21D 9/52* (2013.01); *C21D 1/25* (2013.01); *C21D 1/673* (2013.01); *C21D 6/008* (2013.01);

(Continued)

(58) Field of Classification Search
CPC . C21D 1/25; C21D 6/005; C21D 7/13; C21D 8/005
See application file for complete search history.

(56) References Cited

U.S. PATENT DOCUMENTS

2007/0107819 A1 5/2007 Gehringhoff et al.
2007/0256762 A1 11/2007 Brodt et al.

(Continued)

FOREIGN PATENT DOCUMENTS

CA 2649519 A1 11/2007
DE 102006001198 A1 7/2007

(Continued)

OTHER PUBLICATIONS

Werner Zeller et al.; The Physical Tools of the Engineer; 1977; 9 pages; 11th Improved Edition; VEB Fachbuchverlag, Leipzig, German Democratic Republic.

(Continued)

*Primary Examiner* — Daniel C. McCracken
(74) *Attorney, Agent, or Firm* — Reinhart Boerner Van Deuren P.C.

(57) ABSTRACT

The invention relates to a process for producing a component having improved elongation at break properties, in which a component is firstly produced, preferably in a hot forming or press curing process, and the component is heat treated after hot forming and/or press curing, where the heat treatment temperature T and the heat treatment time t essentially satisfy the numerical relationship $T \geq 900 \cdot t^{-0.087}$, where the heat treatment temperature T is in ° C. and the heat treatment time t is in seconds. The invention also relates to a component, in particular an automobile body component or the chassis of a motor vehicle, which has been produced (Continued)

by such a process. The invention further relates to the use of such a component as part of an automobile body or a chassis of a motor vehicle.

19 Claims, 8 Drawing Sheets

Related U.S. Application Data of application No. PCT/EP2009/066984, filed on Dec. 11, 2009.

(51) Int. Cl.

| | |
|---|---|
| ***C21D 1/673*** | (2006.01) |
| ***C21D 8/00*** | (2006.01) |
| ***C22C 38/00*** | (2006.01) |
| ***C22C 38/04*** | (2006.01) |
| ***C22C 38/02*** | (2006.01) |
| ***C21D 9/48*** | (2006.01) |
| ***C21D 7/13*** | (2006.01) |
| ***C21D 6/00*** | (2006.01) |
| ***C23C 2/02*** | (2006.01) |
| ***C23C 2/12*** | (2006.01) |
| ***C23C 22/02*** | (2006.01) |
| ***C23C 22/05*** | (2006.01) |
| ***C23C 22/78*** | (2006.01) |
| ***C25D 3/44*** | (2006.01) |
| ***C25D 5/36*** | (2006.01) |
| ***C25D 7/00*** | (2006.01) |

(52) U.S. Cl.

CPC ..... *C21D 7/13* (2013.01); *C21D 8/005* (2013.01); *C21D 9/48* (2013.01); *C22C 38/002* (2013.01); *C22C 38/02* (2013.01); *C22C 38/04* (2013.01); *C23C 2/02* (2013.01); *C23C 2/12* (2013.01); *C23C 22/02* (2013.01); *C23C 22/05* (2013.01); *C23C 22/78* (2013.01); *C25D 3/44* (2013.01); *C25D 5/36* (2013.01); *C25D 7/00* (2013.01)

(56) References Cited

U.S. PATENT DOCUMENTS

| | | | | |
|---|---|---|---|---|
| 2009/0151821 | A1 | 6/2009 | Bilgen et al. | |
| 2011/0259482 | A1 * | 10/2011 | Peters et al. | 148/590 |

FOREIGN PATENT DOCUMENTS

| | | | | |
|---|---|---|---|---|
| DE | 102005054847 | B3 | 10/2007 | |
| DE | 102006019395 | A1 | 10/2007 | |
| DE | 102006019567 | B3 | 11/2007 | |
| DE | 102006053819 | A1 * | 5/2008 | C21D 1/18 |
| DE | 102007023306 | A1 * | 11/2008 | C22C 38/14 |
| FR | 2671749 | A1 | 7/1992 | |
| WO | WO 2008/138642 | A1 | 11/2008 | |

OTHER PUBLICATIONS

Small Encyclopaedia; 1977; 10 pages; 10th completely revised Edition; VEB Bibliographisches Institut, Leipzig, German Democratic Republic.

Manuel Maikranz-Valentin et al., Eigenschaftsoptimierte Bauteile durch modifizierte thermo-mechanische Prozessrouten beim Formhärten, May 10-11, 2007, pp. 115-126, Düsseldorf, Germany.

Philipp Hein and Joël Wilsius; Status and Innovation Trends in Hot Stamping of USIBOR 1500 P; Steel Research International; Feb. 1, 2008; pp. 85-91; vol. 79, No. 2; Verlag Stahleisen GmbH, Dusseldorf, Germany.

Machine translation of DE 102006053819; 2008.

* cited by examiner

METHOD FOR PRODUCING A COMPONENT HAVING IMPROVED ELONGATION AT BREAK PROPERTIES

CROSS-REFERENCE TO RELATED PATENT APPLICATIONS

This patent application is a continuation of co-pending U.S. patent application Ser. No. 13/156,260, filed Jun. 8, 2011, which is a continuation of PCT Application No. PCT/EP2009/066984, filed Dec. 11, 2009, which claims the benefit of German Application No. 10 2008 055 514.2, filed Dec. 12, 2008, the entire teachings and disclosure of which are incorporated herein by reference thereto.

FIELD OF THE INVENTION

The invention relates to a method for producing a component having improved elongation at break properties, in which a component is firstly produced, preferably in a hot forming and/or press curing process, and the component is tempered after hot forming and/or press curing. The invention also relates to a component produced with this method, preferably a component of the body or the chassis of a motor vehicle. The invention further relates to the use of such a component as part of the body or chassis of a motor vehicle.

BACKGROUND OF THE INVENTION

In the construction of motor vehicles the safety of the motor vehicle and economy of production and operation both have important roles to play. On the one hand the body or the chassis of the motor vehicle should provide a high level of safety in a crash, and on the other the weight of these components should be kept as low as possible in order to lower material costs and operating costs. For this reason in the state of the art hardened components, preferably hot formed or press cured components are used. To this end sheet steel or a pre-formed component is heated to an austenetisation temperature of higher than $AC_3$ and then rapidly cooled in a tool, so that within the component a martensitic and/or a bainitic structure develops. In this way strengths $R_m$ of 1200-1600 MPa, yield strengths $R_{p0.2}$ of more than 900 MPa and $A_{80}$ elongation at break values of up to 6% can be achieved. Such components have high dimensional stability and are highly resistant to deformation in a crash. But these components do lack residual strain capability. In order to avoid cracking of the components due to their high level of hardness, it is necessary that the components also have a certain ductility. In order to achieve this, such components are tempered following a press curing or hot forming process. Up until now during such tempering processes the components have been tempered for a dwell time of, for example, approximately 10 minutes at an average temperature of 400° C. The components tempered in this way demonstrate a clear improvement in their ductility or their folding behaviour. In order to reduce the risk of material failure during an axial crash loading, i.e. in particular during a head-on crash or rear shunt, it is necessary, however, to increase the elongation at break values $A_{80}$ of the components.

Elongation at break means the residual relative change in length compared with the starting length after the break of the test piece in a tensile test. Here the elongation at break value $A_5$ relates to a round test piece, the starting length of which is five times its diameter. The elongation at break value $A_{80}$ on the other hand refers to a test piece with a starting length of 80 mm. For the same $A_5$ material the elongation at break value will take higher values than the elongation at break values $A_{80}$. Unless otherwise stated, in this application the elongation at break value $A_{80}$ is intended.

From DE 10 2005 054 847 B3 a highly rigid steel component is known for which the elongation at break value $A_5$ was increased by a tempering process in the temperature range between 320 and 400° C. to between 6% and 12%. It has been shown, however, that the known method does not lead to high elongation at break values with sufficient reliability.

SUMMARY OF THE INVENTION

The object forming the basis of the invention is thus to provide a component and a method for the production thereof, in which the elongation at break properties are further improved and achieved in a process that offers greater reliability. In this patent application a component can also be understood to be a semi-finished product.

This object is achieved according to the invention in that the tempering temperature T and the tempering time t substantially satisfy the numerical relationship $T \geq 900 \cdot t^{-0.087}$, wherein the tempering temperature T is to be expressed in ° C. and the tempering time t in seconds. It has been shown that in a tempering process that observes the above-mentioned numerical relationship the elongation at break value $A_{80}$ is increased sufficiently and in a process that offers reliability.

An excessive reduction in the hardness of the component can be avoided in a preferred embodiment in that the tempering temperature T is lower than the $AC_1$ temperature, in particular lower than 700° C. It has been shown that in this way the structure of the martensite changes, but a conversion of the martensite into other structural components and thus an excessive reduction in the strength or the yield point can be prevented.

In a further preferred embodiment the tempering time at a tempering temperature of approximately 500° C. is at least 20 minutes, at a tempering temperature of approximately 550° C. at least 5 minutes, and at a tempering temperature of approximately 600° C. at least 3 minutes. It has been shown that these parameters, for performing the tempering process, guarantee a sufficient increase in the elongation at break value $A_{80}$ and at the same time prevent too great a loss in hardness.

The production of a component with particularly good crash properties under axial loading is achieved in a further embodiment of the method in that the tempering temperature is at least 500°, preferably 550° C., in particular 600° C. and the tempering time is selected to be great enough that the elongation at break value $A_{80}$ of the component is increased by approximately 15%, in particular by approximately 20%, preferably by approximately 25%.

In a further embodiment of the method the component substantially consists of a manganese-boron steel, in particular a manganese-boron tempering steel, preferably a 22MnB5 tempering steel. The advantage of using such steels is that the components produced with the method have a particularly high hardness and as a result a reduction in the material thickness and thus a lower weight is possible.

In a further embodiment of the method the component is coated or uncoated. The advantage of using coated components is that the material properties of the component can be matched to specific requirements by means of the coatings. So, for example, scale-free hot forming can be guaranteed.

The use of uncoated components is, on the other hand, more economical than using coated components.

In a further embodiment of the method prior to tempering the component is coated with an inorganic, an organic and/or or an inorganic-organic coating. Such coatings can serve as corrosion protection, provide an improvement in the paint adhesion compared with uncoated components, such as for example in epoxy resin systems, or perform other functions.

The production of a component that guarantees in particular long-term crash safety is achieved in a further embodiment in that the component is coated with a corrosion protection coating. The corrosion protection coating prevents the component being attacked by corrosion with a deterioration over time in its crash safety properties.

A particularly even application of the coating and thus the production of components with homogeneous surface properties are achieved in a further embodiment of the method in that prior to tempering, the component is coated electrolytically and/or by hot-dip processing. Thus prior to tempering the component can for example be coated with an aluminium-silicon (AS), a zinc (Z) and/or an electrolytically applied zinc (ZE) or aluminium coating.

In a further preferred embodiment of the method the component is a component of the body or chassis of a motor vehicle. The method is particularly well-suited to the production of such components since for these components in order to achieve a high level of crash safety a higher elongation at break $A_{80}$ value is required.

The problem for the invention is further solved by a component which has in particular been produced by a method according to the invention, wherein the component has a tensile strength $R_m$ of 700-1,100 MPa, a yield point $R_{p0.2}$ of 750-1,000 and an elongation at break value $A_{80}$ of more than 6%.

It has been shown that such components have a particularly favourable combination of good elongation at break properties and high strength.

In a particularly preferred embodiment of the component, in the event of a crash the component is subjected to a tensile loading. This is particularly advantageous since the good elongation at break properties of the component are also able to withstand a strong tensile loading without this resulting in failure of the material.

Particularly high stability of the body of a motor vehicle in a crash is achieved in a further embodiment in that the component is a side rail of a vehicle frame. In particular in the event of a head-on crash or rear shunt, the side rails of a vehicle frame are subject to high axial loadings so that the good elongation at break properties of the component play an important role at such a point.

The object forming the basis of the invention is finally achieved in that a component according to the invention is used as part of the body or chassis of a motor vehicle. The component is particularly well-suited to such an application, since because of its high level of hardness and its very good elongation at break properties the safety of the occupants of the vehicle is increased. The high level of hardness of the component also allows a low material thickness to be used and thus a reduction in the weight of the vehicle body work. This can lead to lower material costs and lower consumption by the vehicle.

BRIEF DESCRIPTION OF THE DRAWINGS

Further features and advantages of the present invention will be explained in more detail in the description of an exemplary embodiment wherein reference is made to the attached drawings. The drawing shows as follows.

DETAILED DESCRIPTION OF THE INVENTION

Figure 1:
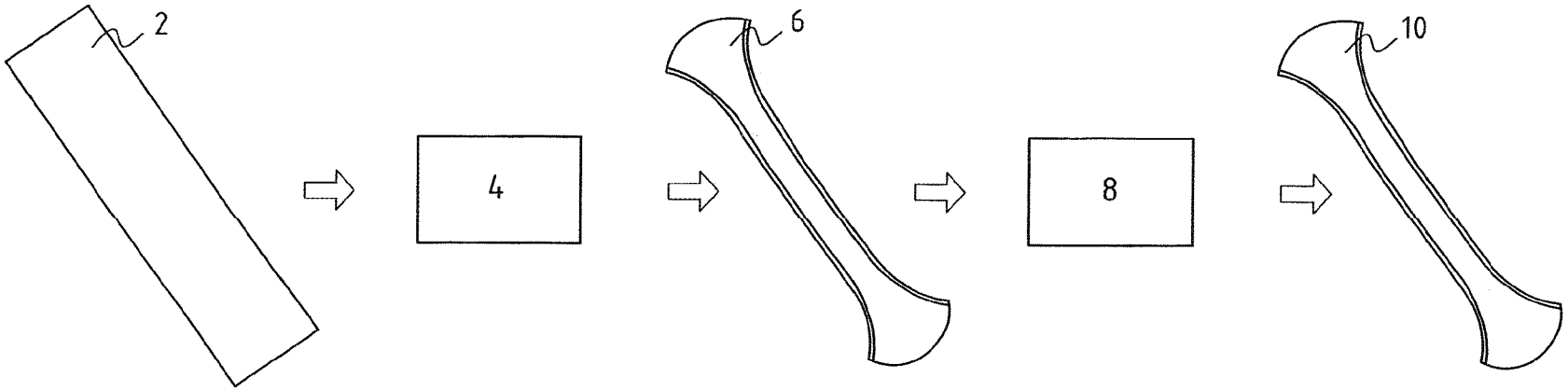
FIG. 1 is an exemplary embodiment of the method according to the invention for producing a component with improved elongation at break properties.

FIG. 1 shows an exemplary embodiment of a method for producing a component with improved elongation at break properties. From a bar 2, which is for example made from manganese-boron steel, initially in a hot forming and press curing process 4, a component 6 is produced. The component 6 is for example a side rail of a motor vehicle's body work. As a result of the hot forming and press curing process the material of the component 6 has a substantially martensitic structure and thus a high level of hardness. The component 6 is then tempered in a tempering step 8. The tempering can for example take place in an oven provided for the purpose, in which the component 6 is maintained by way of example for approximately 10 minutes at approximately 550° C. Compared with the component 6 the tempered component 10 has an elongation at break value $A_{80}$ that is 60% higher. The hardness of the tempered component 10 is not excessively reduced compared with the component 6.

Figure 2:
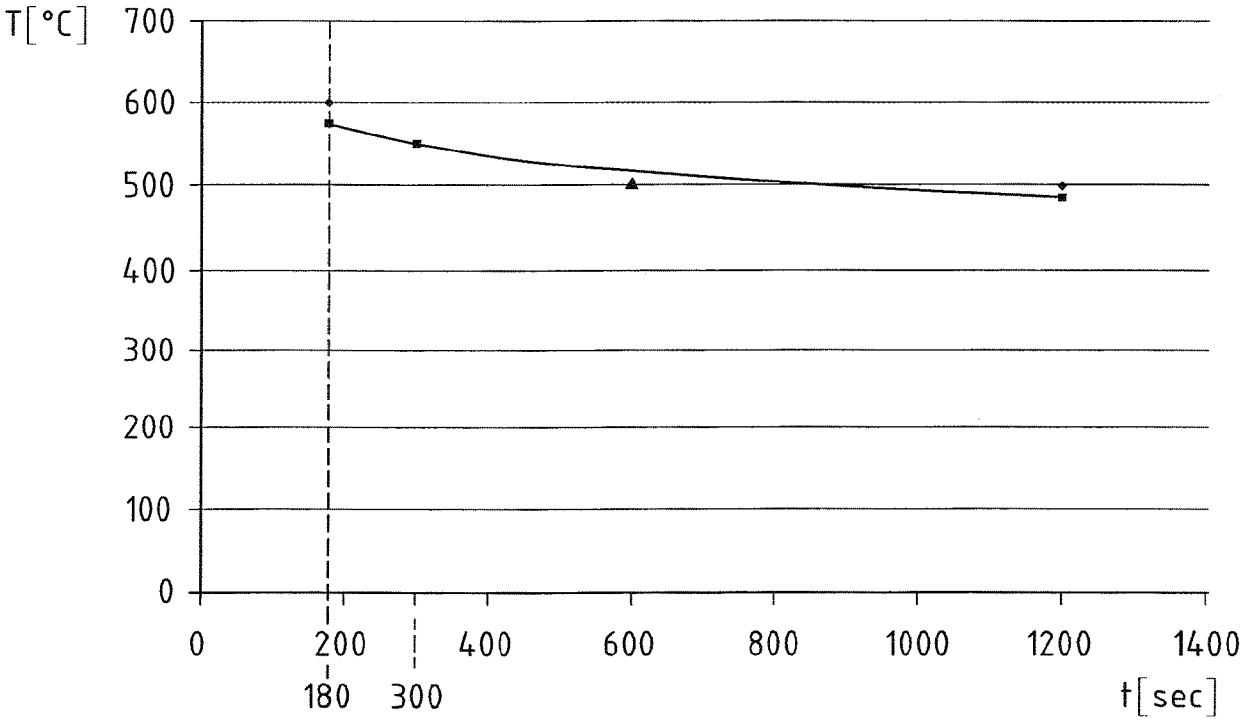
FIG. 2 is a diagram with the parameters for the tempering process.

FIG. 2 shows a diagram with the parameters for the tempering process. The tempering time t in seconds is plotted against the abscissa and the tempering temperature T in ° C. against the ordinate. The solid line curve corresponds to the numerical relationship $T=900\cdot_{t}^{-0.087}$, wherein the tempering temperature T is expressed in ° C. and the tempering time t in seconds.

For the selection of the tempering temperature T and the tempering time t all pairs of values that are located in the diagram above the plotted curve and below the $AC_1$-temperature are suitable. Out of practical considerations here a tempering time t of between 180 and 1200 s is taken into account in particular. Thus at lower tempering times the necessary tempering temperatures are too high and at high tempering times on the other hand the production time is too long.

In FIGS. 3*a* to 3*d* the influence of the tempering temperature and of the tempering time on the material properties of components is shown. The components are strips of 22MnB5 steel of 1.47 mm in thickness with an aluminium-silicon coating (AS). In a first step the samples were heated for 6 minutes at 920° C. and austenetised and then press cured for 15 seconds at a pressure of 6 bar in a cooling tool. In a second step the components obtained in this way were tempered at differing tempering temperatures in the forced-air oven for various tempering times.

Figure 3A:
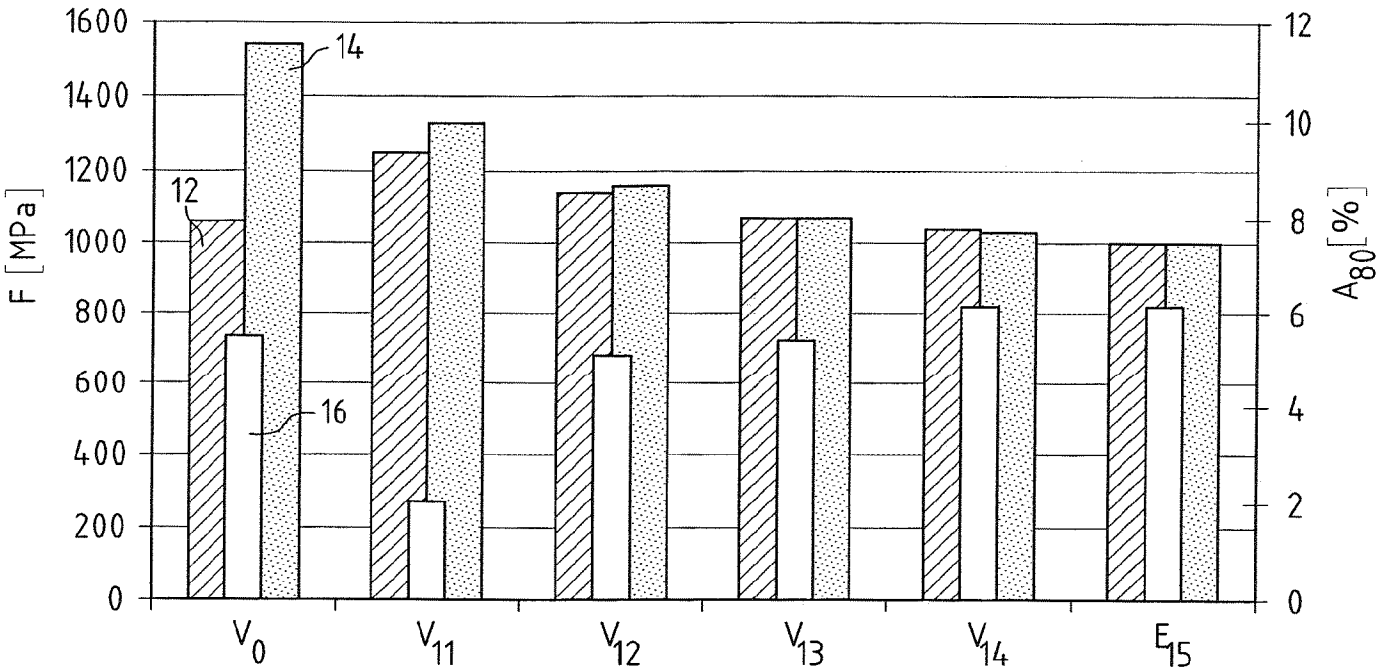
FIG. 3*a* is a diagram showing the influence of the tempering time on the material properties of a component at a tempering temperature of 450° C.

FIG. 3*a* shows for this, measurements of the yield strength $R_{p0.2}$ 12, the tensile strength $R_m$ 14 and measurements of the elongation at break $A_{80}$ 16 for comparative components V and for components E produced with exemplary embodiments of the method according to the invention. All measurements were carried out according to DIN. The strength Rm in Mpa is plotted against the ordinate on the left-hand side and the elongation at break $A_{80}$ against the ordinate on the right-hand side in percent. The comparative component $V_0$ was not tempered following complete austenitisation and press curing, $V_{11}$ was tempered for 5 minutes following press curing, $V_{12}$ for 10 minutes, $V_{13}$ for 20 minutes and $V_{14}$ for 30 minutes at 450° C. Using an exemplary embodiment of the method according to the invention component $E_{15}$ was tempered for 60 minutes at 450° C. It is clear from the diagram that the elongation at break value initially drops during tempering and then as the tempering time increases rises even to above the elongation at break value directly after press curing. Thus the elongation at break value of the component $E_{15}$ exceeds that of the un-tempered component $V_0$ by approximately 13%. The yield point shows a slight retraction as the tempering time increases while this is greater for the tensile strength.

Figure 3B:
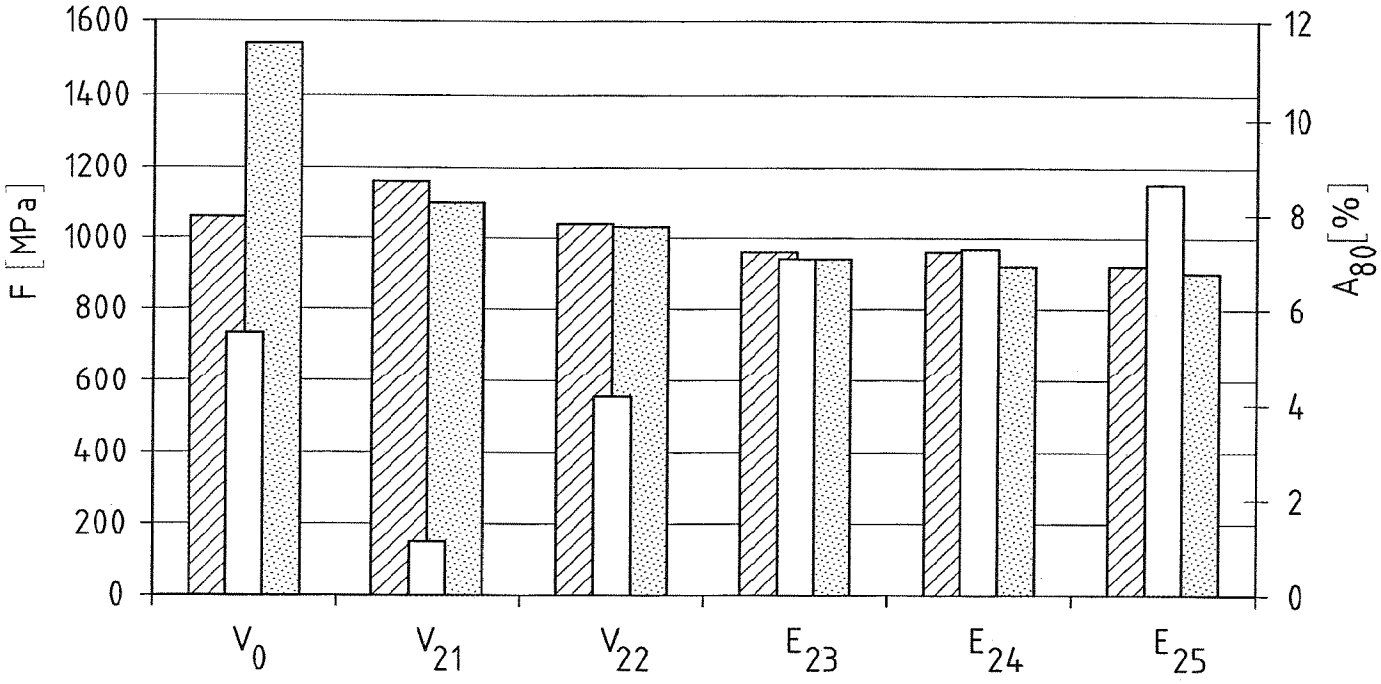
FIG. 3*b* is a diagram similar to FIG. 3*a* for a tempering temperature of 500° C.

FIG. 3*b* shows a diagram similar to that of FIG. 3*a* for a tempering temperature of 500° C. The comparative component $V_{21}$ was tempered at 500° C. following press curing for 5 minutes and $V_{22}$ for 10 minutes. The components $E_{23}$, $E_{24}$ and $E_{25}$ produced using exemplary embodiments of the method according to the invention were tempered for 20, 30 and 60 minutes respectively at 500° C. The diagram shows that the elongation at break value at this temperature for the component $E_{23}$ tempered for 20 minutes already exceeds the elongation at break value of the component $V_0$ by almost 30%.

Figure 3C:
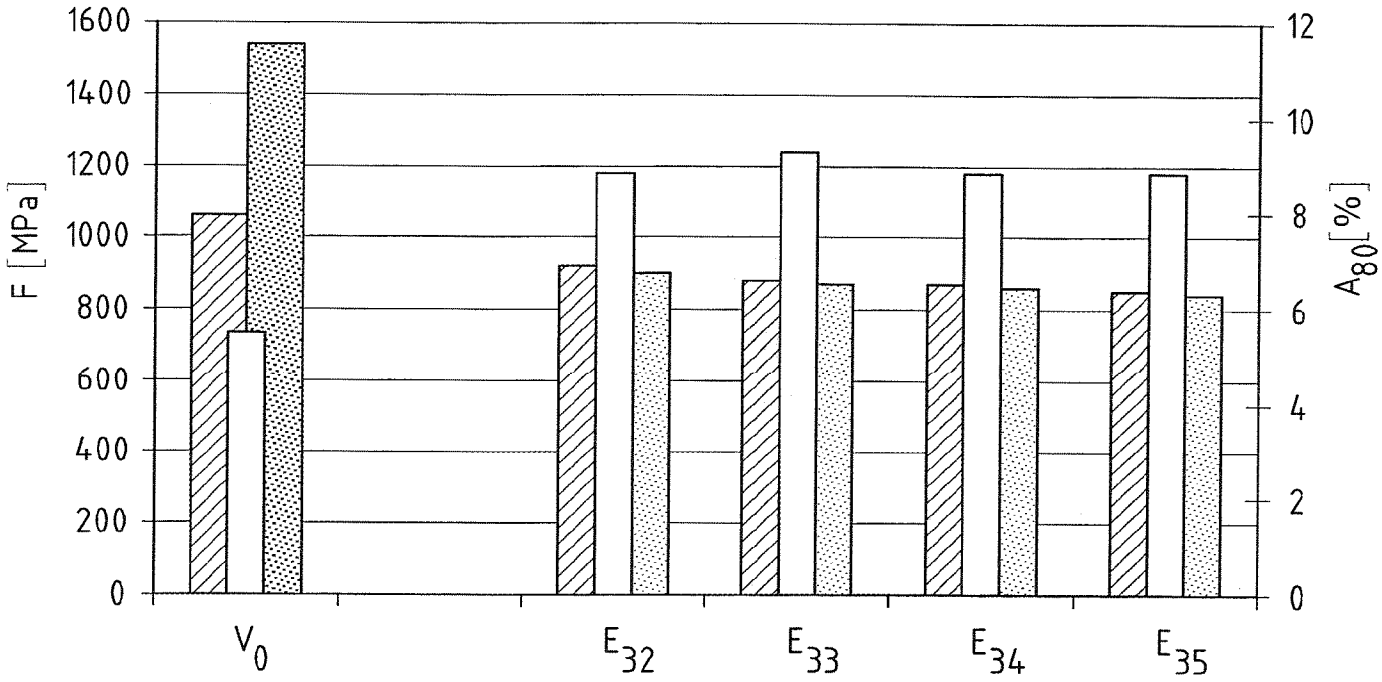
FIG. 3*c* is a diagram similar to FIG. 3*a* for a tempering temperature of 550° C.

FIG. 3*c* shows a diagram similar to that of FIG. 3*a* for a tempering temperature of 550° C. The components $E_{32}$, $E_{33}$, $E_{34}$ and $E_{35}$ produced using exemplary embodiments of the method according to the invention were tempered for 10, 20, 30 and 60 minutes respectively at 550° C.

Figure 3D:
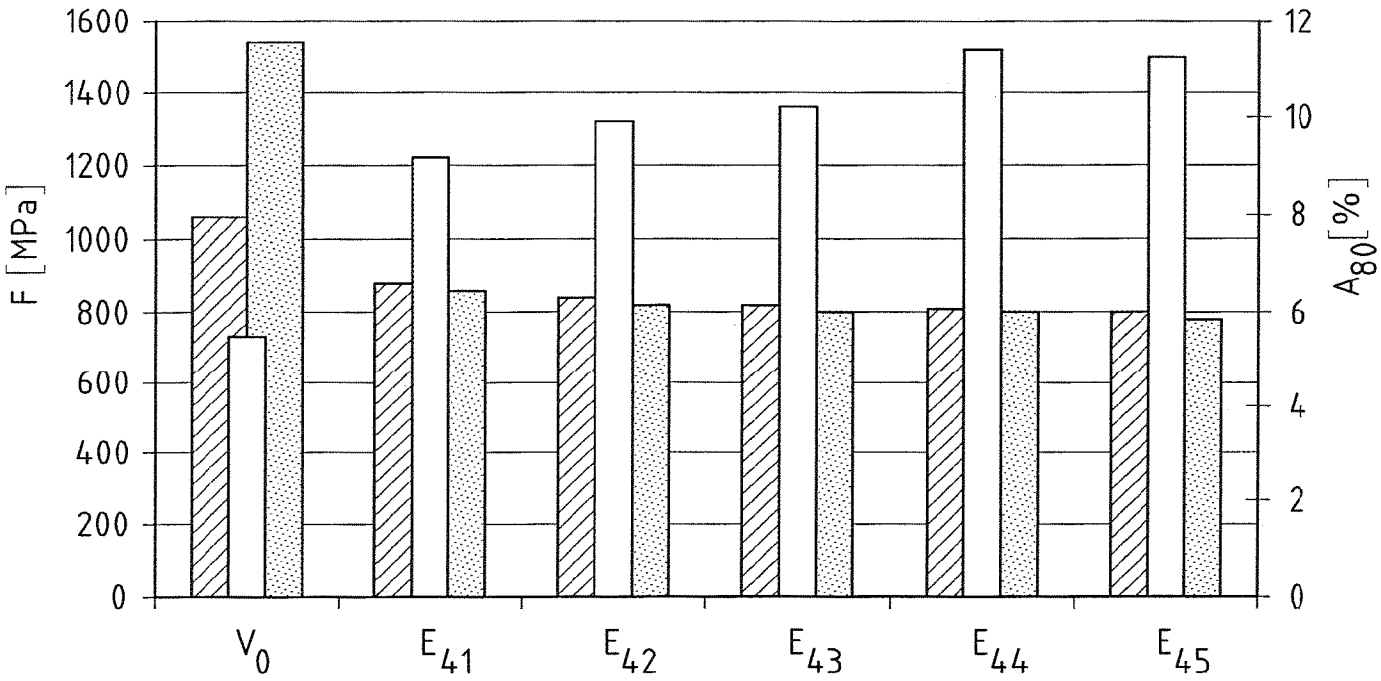
FIG. 3*d* is a diagram similar to FIG. 3*a* for a tempering temperature of 600° C.

FIG. 3*d* shows a diagram similar to that of FIG. 3*a* for a tempering temperature of 600° C. The components $E_{41}$, $E_{42}$, $E_{43}$, $E_{44}$ and $E_{45}$ produced using exemplary embodiments of the method according to the invention were tempered for 5, 10, 20, 30 and 60 minutes respectively at 600° C. At this tempering temperature the elongation at break value of the component $E_{41}$ already exceeds the elongation at break value of component $V_0$ by approximately 66%.

From diagrams 3*a* to 3*d* it can be seen that with long tempering times the elongation at break value of the components increases more sharply or that the tensile strength and the yield strength of the components fall more quickly the higher the tempering temperature. It is therefore advantageous to select the tempering temperature so that in the time available for the tempering process the necessary increase in the elongation at break value is achieved. In selecting the parameters for the tempering process it is also crucial that a sensible compromise is found between the increase in elongation at break and the reduction in hardness of the material. It was noted among other things that the elongation at break, when the tempering time is increased, initially rises very quickly before transitioning to a slow increase or even saturation. Through the selection according to the invention of the tempering time at a specified tempering temperature the elongation at break value can be sufficiently increased and the yield strength and stability values reduced. The result is that components can be provided with optimised mechanical characteristic values in terms of yield strength, tensile strength and elongation values.

Figure 4:
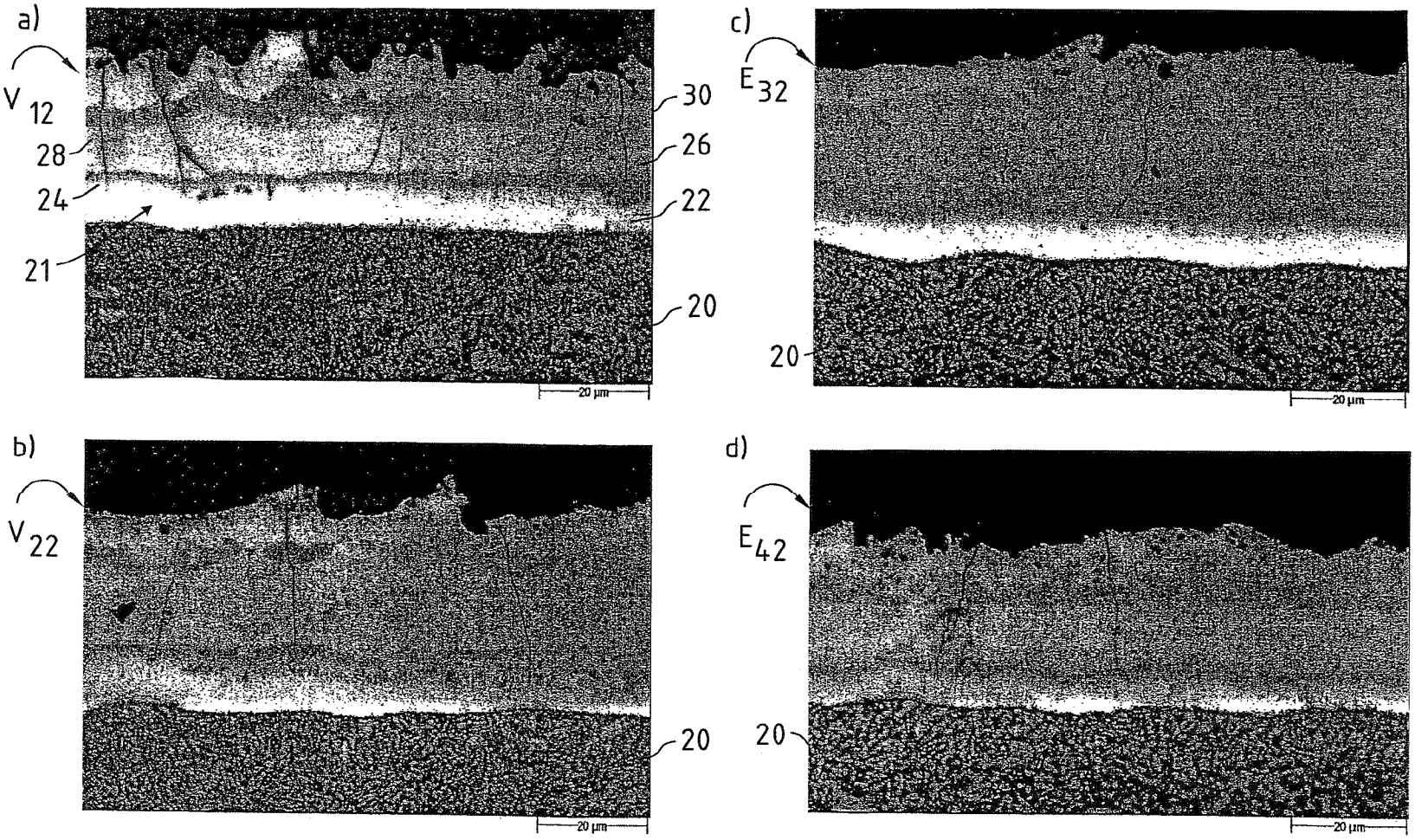
FIG. 4 is four cross-sectional views of coated components following various tempering treatments and FIG. 5 is a vehicle frame of a motor vehicle with exemplary embodiments of components according to the invention.

FIG. 4 shows cross-sections of the components $V_{12}$, $V_{22}$, $E_{32}$ and $E_{42}$ described above. The tempering time for all components is 5 minutes. In the cross-sections the core material 20 of the respective component and the AS coatings 21 applied to this can be seen. With all AS coatings there are clear phase limits within the AS coating 21, which can be applied with up to five alloy coatings 22, 24, 26, 28, 30. In step a) the core material 20 of the component $V_{12}$ exhibits the structure of tempered martensite. For the components $E_{32}$ and $E_{42}$ tempered using an exemplary embodiment of the method according to the invention the granularity of this structure has clearly increased. A conversion of the martensitic structure has thus been achieved without the martensite being converted into other types of structure. In this way an excessive reduction in the stability of the components is prevented.

Figure 5:
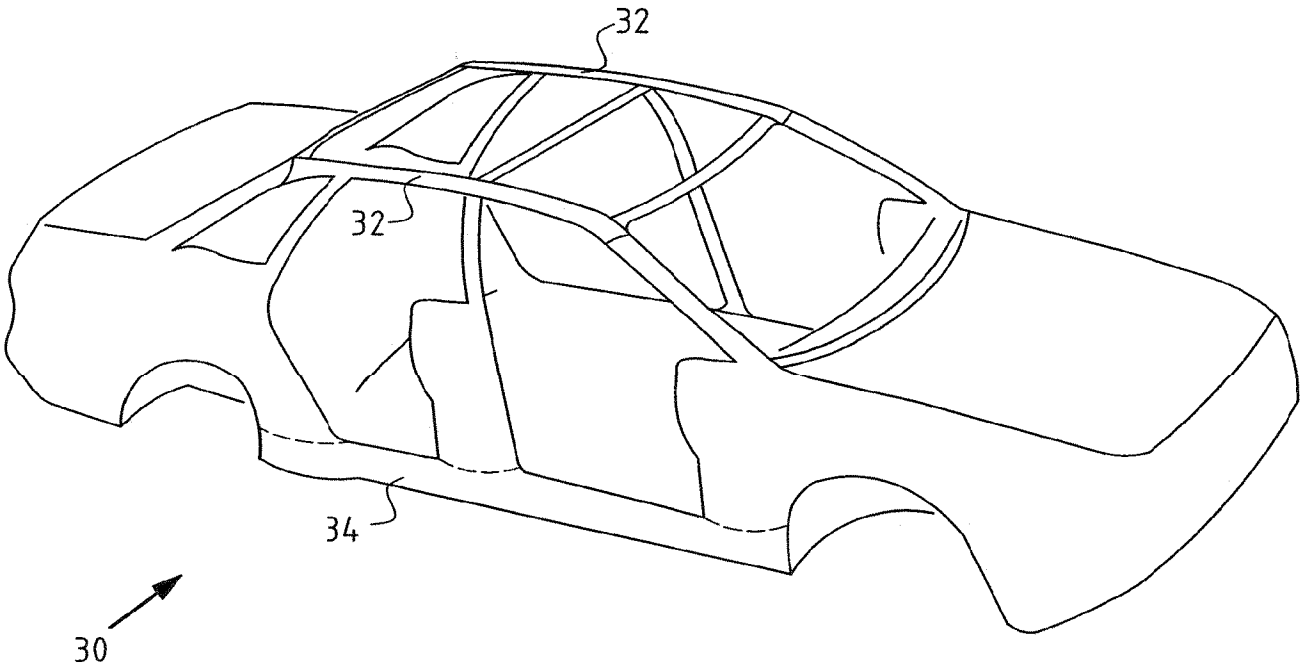

FIG. 5 shows a vehicle frame 30, which has side rails in the roof area 32 and side rails in the floor area 34. For these side rails 32, 34 components produced by a method according to the invention are used. Since these components have a high elongation at break $A_{80}$ value and thus in the event a crash, in particular in a head-on crash or rear shunt and the tensile loadings resulting from these, demonstrate high stability, the stability of the vehicle frame 30 is thereby guaranteed.

The invention claimed is:

1. Method for manufacturing a component for a body part or a chassis of a motor vehicle with improved elongation at break properties, in which a component is first produced by one of a hot forming and press curing process, and in which the component is tempered after the one of hot forming and press curing processes characterised in that a tempering temperature T and a tempering time t substantially satisfy the numerical relationship $T \geq 900 \cdot t^{-0.087}$, wherein the tempering temperature T is expressed in ° C. and the tempering time tin seconds and wherein the tempering temperature is at least 500° C. and lower than $AC_1$ temperature.

2. Method according to claim 1, characterised in that the tempering time at a tempering temperature of approximately 500° C. is at least 20 minutes, at a tempering temperature of approximately 550° C. at least 5 minutes, and at a tempering temperature of approximately 600° C. at least 3 minutes.

3. Method according to claim 1, characterised in that the tempering temperature is at least 500° C. and the tempering time is selected to be high enough that the elongation at break value A80 of the component is increased by approximately 15%.

4. Method according to claim 1, characterised in that the component substantially consists of a manganese-boron steel.

5. Method according to claim 1, characterised in that the component is coated or uncoated.

6. Method according to claim 1, characterised in that prior to tempering, the component is coated with an inorganic, an organic and/or an inorganic-organic coating.

7. Method according to claim 1,
characterised in that
the component is coated with a corrosion protection coating.

8. Method according to claim 1,
characterised in that
prior to tempering, the component is coated electrolytically and/or by hot-dip processing.

9. Method according to claim 1,
characterized in that
the tempering temperature T is lower than 700° C.

10. Method according to claim 1,
characterized in that
the tempering temperature is at least 500° C. and the tempering time is selected to be high enough that the elongation at break value A80 of the component is increased by approximately 20%.

11. Method according to claim 1,
characterized in that
the tempering temperature is at least 500° C. and the tempering time is selected to be high enough that the elongation at break value A80 of the component is increased by approximately 25%.

12. Method according to claim 1,
characterized in that
the tempering temperature is at least 550° C. and the tempering time is selected to be high enough that the elongation at break value A80 of the component is increased by approximately 15%.

13. Method according to claim 1,
characterized in that
the tempering temperature is at least 550° C. and the tempering time is selected to be high enough that the elongation at break value A80 of the component is increased by approximately 20%.

14. Method according to claim 1,
characterized in that
the tempering temperature is at least 550° C. and the tempering time is selected to be high enough that the elongation at break value A80 of the component is increased by approximately 25%.

15. Method according to claim 1,
characterized in that
the tempering temperature is at least 600° C. and the tempering time is selected to be high enough that the elongation at break value A80 of the component is increased by approximately 15%.

16. Method according to claim 1,
characterized in that
the tempering temperature is at least 600° C. and the tempering time is selected to be high enough that the elongation at break value A80 of the component is increased by approximately 20%.

17. Method according to claim 1,
characterized in that
the tempering temperature is at least 600° C. and the tempering time is selected to be high enough that the elongation at break value A80 of the component is increased by approximately 25%.

18. Method according to claim 1,
characterized in that
the component substantially consists of a manganese-boron tempering steel.

19. Method according to claim 1,
characterized in that
the component substantially consists of 22MnB5 tempering steel.

* * * * *